US011769396B2

(12) United States Patent
Wolf et al.

(10) Patent No.: US 11,769,396 B2
(45) Date of Patent: Sep. 26, 2023

(54) INITIATING AND MONITORING SELF-TEST FOR AN ALARM SYSTEM USING A MOBILE DEVICE

(71) Applicant: Honeywell International Inc., Charlotte, NC (US)

(72) Inventors: Benjamin H. Wolf, Leicester (GB); Hariprasad Kozhikkotakathitta Veetil, Bangalore (IN); Michael Barson, Nuneaton (GB); Christopher Dearden, Melton Mowbray (GB)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/168,469

(22) Filed: Feb. 5, 2021

(65) Prior Publication Data

US 2022/0254247 A1 Aug. 11, 2022

(51) Int. Cl.
*G08B 29/14* (2006.01)
*G08B 17/00* (2006.01)

(52) U.S. Cl.
CPC ..... *G08B 29/145* (2013.01); *G08B 17/00* (2013.01)

(58) Field of Classification Search
None
See application file for complete search history.

(56) References Cited

U.S. PATENT DOCUMENTS 5,008,081 A * 4/1991 Blau ..... G01N 11/04 422/63
6,108,322 A * 8/2000 Kotzin ..... H04W 36/0094 370/333
6,401,099 B1 * 6/2002 Koppolu ..... G06F 9/543
9,459,142 B1 * 10/2016 Huseynov ..... G08B 17/12
9,992,662 B1 * 6/2018 Hua ..... H04W 4/33
10,176,067 B1 * 1/2019 Bramhill ..... G06F 11/2294
10,243,823 B1 * 3/2019 Bharadwaj ..... H04B 10/077
2001/0040798 A1 * 11/2001 Appelberg ..... G08B 7/062 362/20
2003/0210138 A1 * 11/2003 Farley ..... G08B 29/145 340/514
2005/0128079 A1 * 6/2005 Berezowski ..... G08B 1/08 340/539.22

(Continued)

FOREIGN PATENT DOCUMENTS

CN 109377741 A 2/2019

OTHER PUBLICATIONS

Extended European Search Report for related European Application No. 22153393.8, dated Jul. 4, 2022 (9 pgs).

*Primary Examiner* — Curtis J King
(74) *Attorney, Agent, or Firm* — Brooks, Cameron & Huebsch, PLLC

(57) ABSTRACT

Devices, systems, and methods for self-testing event devices of a building alarm system are described herein. One mobile device includes a user interface, a memory, and a processor configured to execute executable instructions stored in the memory to: generate, a list of event devices of an alarm system that are available for testing, providing a device selection tool that allows a user to select a number of event devices from the list of event devices, and providing a self-test initiation tool that generates an initiation message that is to be sent to the selected number of event devices.

20 Claims, 8 Drawing Sheets

(56) References Cited

U.S. PATENT DOCUMENTS

2005/0217872 A1* 10/2005 Oh ..... G08B 25/08 169/67
2005/0280527 A1* 12/2005 Farley ..... G08B 29/145 340/514
2006/0056352 A1* 3/2006 Proctor ..... H04B 7/15542 370/332
2006/0139161 A1* 6/2006 Beghelli ..... G08B 25/009 340/514
2006/0267756 A1* 11/2006 Kates ..... H04B 1/69 340/521
2006/0273896 A1* 12/2006 Kates ..... G08B 25/10 340/539.18
2007/0093991 A1* 4/2007 Hoogenboom ..... G08B 25/003 702/188
2007/0241877 A1* 10/2007 Jobe ..... G08B 25/009 340/506
2007/0241878 A1* 10/2007 Jobe ..... G08B 25/14 340/506
2007/0241879 A1* 10/2007 Jobe ..... G08B 29/22 340/506
2008/0084291 A1* 4/2008 Campion ..... G08B 29/145 340/514
2009/0058857 A1* 3/2009 Ballantyne ..... H04L 41/5074 345/440
2009/0184816 A1* 7/2009 Hosey ..... G08B 29/14 340/506
2010/0315224 A1* 12/2010 Orsini ..... G08B 29/126 340/516
2011/0115468 A1* 5/2011 Kantake ..... G01R 31/31922 324/76.77
2011/0241872 A1* 10/2011 Mahaffey ..... H04L 41/22 340/539.13
2012/0154141 A1* 6/2012 Piccolo, III ..... G08B 26/007 340/539.11
2013/0063606 A1* 3/2013 McClay ..... H04N 17/04 348/181
2013/0076506 A1* 3/2013 Smith ..... G08B 29/22 340/514
2013/0230913 A1* 9/2013 Florescu ..... G01N 33/54366 435/288.7
2014/0266672 A1* 9/2014 Farley ..... G08B 29/185 340/506
2014/0266676 A1* 9/2014 Piccolo, III ..... G08B 29/126 340/514
2014/0340215 A1* 11/2014 Piccolo, III ..... G08B 29/126 340/514
2015/0248832 A1* 9/2015 Piccolo, III ..... G08B 29/145 340/514
2015/0302727 A1* 10/2015 Piccolo, III ..... G08B 29/145 340/514
2015/0304611 A1* 10/2015 Nakase ..... G06K 7/10415 348/143
2015/0348399 A1* 12/2015 Cree ..... G08B 29/145 715/740
2016/0095049 A1* 3/2016 Fan ..... H04W 48/16 370/254
2016/0148498 A1* 5/2016 Ruszala ..... G06F 3/04842 340/506
2016/0224195 A1* 8/2016 Okabe ..... G06F 3/0482
2017/0111244 A1* 4/2017 Strater ..... H04W 28/0284
2017/0186297 A1* 6/2017 Brenner ..... G08B 15/004
2017/0193811 A1* 7/2017 Stowell ..... G08C 17/02
2017/0278381 A1* 9/2017 Nalukurthy ..... G08B 29/145
2018/0012173 A1* 1/2018 Leen ..... G05B 19/041
2018/0012482 A1* 1/2018 Brown ..... G08B 29/145
2018/0061217 A1* 3/2018 Eichler ..... G08B 29/14
2018/0122221 A1* 5/2018 Norton ..... G08B 25/10
2018/0344116 A1* 12/2018 Schriesheim ..... A47L 9/2852
2019/0378402 A1* 12/2019 Bouchard ..... G08B 17/107
2020/0159339 A1* 5/2020 Ruan ..... H04N 5/33
2021/0038936 A1* 2/2021 Hofmann ..... A62C 37/50
2021/0065536 A1 3/2021 Dearden et al.
2021/0146261 A1* 5/2021 Hiatt ..... A63F 13/5375
2021/0149011 A1* 5/2021 Wetzker ..... G08B 29/26
2021/0183231 A1* 6/2021 Arellano Valderrama ..... G08B 29/145

* cited by examiner

INITIATING AND MONITORING SELF-TEST FOR AN ALARM SYSTEM USING A MOBILE DEVICE

TECHNICAL FIELD

The present disclosure relates to devices, systems, and methods for initiating and monitoring self-test for an alarm system using a mobile device.

BACKGROUND

Large facilities (e.g., buildings), such as commercial facilities, office buildings, hospitals, and the like, may have an alarm system that can be triggered during an emergency situation (e.g., a fire) to warn occupants to evacuate. For example, an alarm system may include a control panel (e.g., a fire control panel) within the building and a plurality of event devices (e.g., hazard sensing devices, such as fire detectors, smoke detectors, carbon monoxide detectors, carbon dioxide detectors, other harmful chemical detectors, audio-visual monitoring devices, etc.) located throughout the facility (e.g., on different floors and/or in different rooms of the facility) that can sense a hazard event occurring in the facility and provide a notification of the hazard event to the occupants of the facility via alarms or other mechanisms.

Maintaining the alarm system can include regular testing of event devices. Such regular testing may be mandated by codes of practice in an attempt to ensure that the event devices are functioning properly.

DETAILED DESCRIPTION

Figure 1:
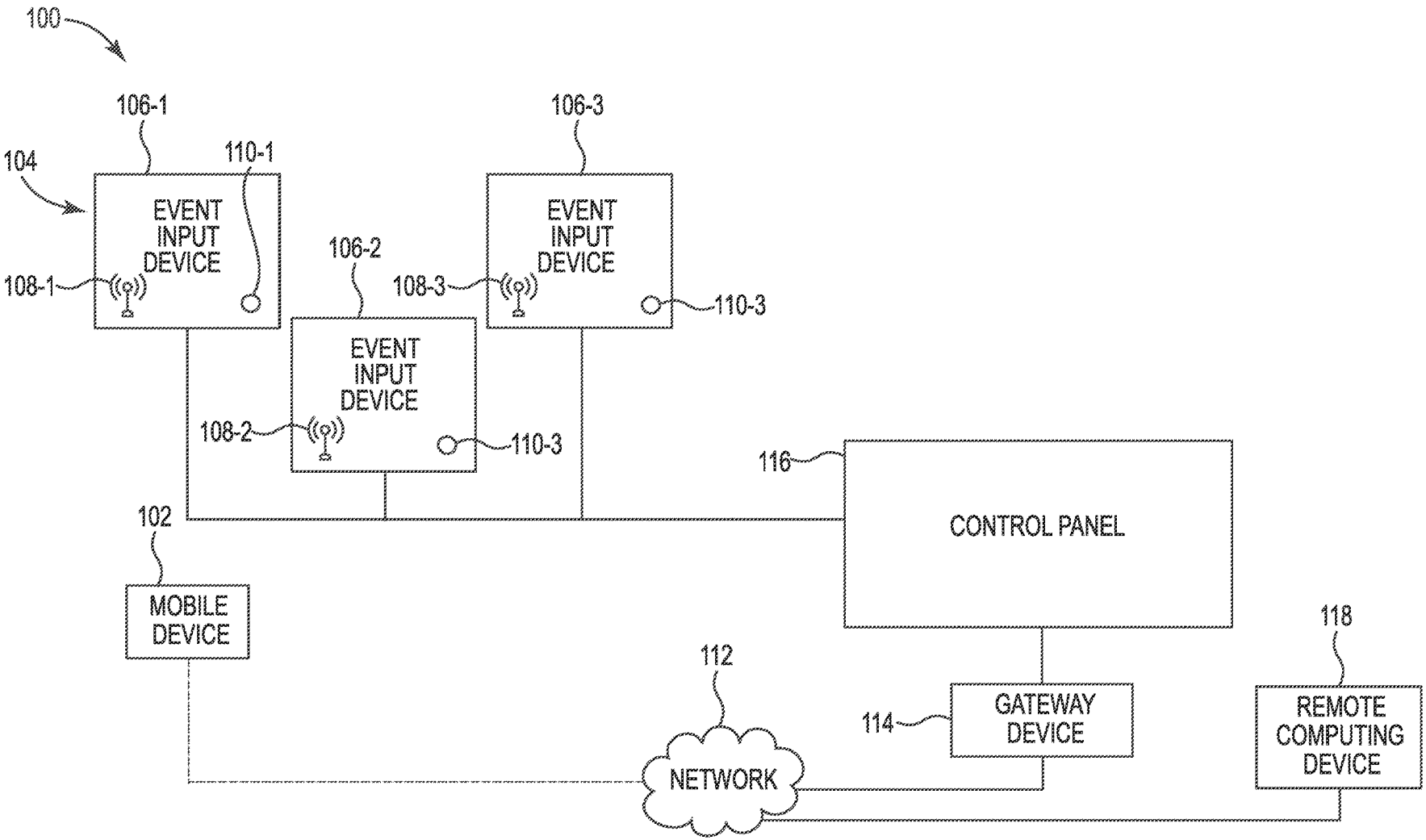
FIG. 1 is an example of a system for event device service, in accordance with one or more embodiments of the present disclosure.

Devices, systems, and methods for self-testing event devices of a building alarm system are described herein. One mobile device includes a user interface, a memory, and a processor configured to execute executable instructions stored in the memory to: generate, a list of event devices of an alarm system that are available for testing, providing a device selection tool that allows a user to select a number of event devices from the list of event devices, and providing a self-test initiation tool that generates an initiation message that is to be sent to the selected number of event devices that have self-testing capabilities.

Service of event devices can include a first user (e.g., such as a technician, engineer, etc.) walking around the facility and visually checking the alarm system components, typically, at the same time as they carry out functional testing of event devices and other components of the alarm system. For example, carrying out smoke testing of fire sensors and visual inspection of fire sensors at the same time the inspector is close enough to visually inspect each fire sensor. While the first user is functionally testing and visually inspecting event devices, a second user may typically interpret signals received at the alarm system control panel. Such signals can be the result of the first user functionally testing event devices in the facility.

Such a manual testing process between the second user at the control panel and the first user testing event devices in the facility may be subject to error. For instance, the first user may identify and test an event device in a space of the facility and activate such a device while the second user views the output from the event device on the alarm system control panel. The first user has to be in continuous communication with the second user to ensure the correct event device is tested, as identifying an incorrect event device can lead to errors in the testing process.

Additionally, in some instances the first user may identify and test an event device in a space of the facility that has multiple event devices. In such an instance, the first user may test a first event device while misinterpreting it to be a second event device as the first and second event devices may be located proximately to one another. Further, in some examples such a facility may not have a network relationship available for the first user to be in communication with the second user and/or the alarm system control panel so that the first user is able to verify they have tested the first event device and not the second event device.

Event device service according to the present disclosure can allow for a user to differentiate between different event devices for testing in a facility. Such an approach can allow a mobile device to be in communication with an event device even if the mobile device may not be in communication with an alarm system control panel. Additionally, the mobile device can allow the user to more easily determine which event device they are interacting with even in an instance where multiple event devices are located near the mobile device as compared with previous approaches. Accordingly, such an approach can ensure a user is able to confirm which event device they are interacting with to avoid errors in the testing process.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 802 in FIG. 4.

As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 is an example of a system for event device maintenance, in accordance with one or more embodiments of the present disclosure. The system 100 can include a mobile device 102, a group 104 of event devices 106-1, 106-2, 106-3, a network 112, a gateway device 114, an on-site alarm system control panel 116, and a remote computing device 118. Each of the event devices 106-1, 106-2, 106-3 can include a beacon 108-1, 108-2, 108-3, respectively, and an indicator 110-1, 110-2, 110-3, respectively, although in some systems, some devices may not.

As illustrated in FIG. 1, the system 100 can include a control panel 116. As used herein, the term "control panel" refers to a device to control components of an alarm system of a facility. For example, the control panel 116 can be a fire control panel that can receive information from event devices 106-1, 106-2, 106-3 (referred to collectively herein as event devices 106) and determine whether a hazard event is occurring or has occurred.

The control panel 116 can be connected to the group 104 of event devices 106. As used herein, the term "event device" refers to a device that can receive an input relating to an event. Such an event can be, for instance, a hazard event such as a fire. For example, an event device can receive an input relating to a fire occurring in the facility. Such event devices 106 can be a part of an alarm system of the facility and can include devices such as fire sensors, smoke detectors, heat detectors, carbon monoxide (CO) detectors, or combinations of these; interfaces; pull stations; input/output modules; aspirating units; and/or audio/visual devices, such as speakers, sounders, buzzers, microphones, cameras, video displays, video screens, among other types of event devices.

These event devices 106 can be automatic, self-test devices, such as smoke detectors, heat detectors, CO detectors, and/or others. Such self-test devices can include mechanisms that generate aerosols, heat, carbon monoxide, etc. and sense these items as appropriate to the type of device being tested in the device to test the performance of the device. This can, for example, be to test the event device's thermal, chemical, and/or photo sensing capabilities.

The event devices 106-1, 106-2, 106-3 can be included in a group 104. Although the group 104 is illustrated in FIG. 1 as including three event devices 106-1, 106-2, 106-3, embodiments of the current disclosure are not so limited. For example, the group 104 can include more event devices or less event devices. Additionally, the system 100 can include more than one group 104 of event devices.

Each of the event devices 106 can include a beacon 108. For example, event device 106-1 can include a beacon 108-1, event device 106-2 can include a beacon 108-2, and event device 106-3 can include a beacon 108-3. As used herein, the term "beacon" refers to a wireless device that broadcasts radio signals. For example, the beacons 108-1, 108-2, 108-3 can emit radio signals to be detected by, for example, a mobile device such as mobile device 102. The beacons 108-1, 108-2, 108-3 can be Bluetooth, Bluetooth LE (e.g., Bluetooth Smart), Bluetooth low energy (BLE), among other types of beacons.

In some examples, each of the event devices 106 can include an indicator 110. For example, event device 106-1 can include an indicator 110-1, event device 106-2 can include an indicator 110-2, and event device 106-3 can include an indicator 110-3 (referred to collectively herein as indicators 110). As used herein, the term "indicator" refers to a signaling mechanism.

In some examples, the indicators 110 can be a visual indicator. For instance, the indicator 110-1 for the event device 106-1 can be a light emitting diode (LED) that, when activated, emits visible light so that a user of the mobile device 102 can locate the event device 106-1.

In some examples, the indicator 110-1 can be an audible indicator. For instance, the indicator 110-1 for the event device 106-1 can be an audio output device (e.g., a speaker, buzzer, etc.) that, when activated emits an audible sound so that a user of the mobile device 102 can locate the event device 106-1.

The mobile device 102 can be connected to the control panel 116 via a gateway device 114. As used herein, the term "gateway device" refers to a device to provide an interface between the control panel 116 and other devices. For example, the gateway device 114 can provide an interface between the mobile device 102 and the control panel 116/event devices 106.

As illustrated in FIG. 1, the control panel 116 can be connected to the mobile device 102 via the gateway device 114 and a network 112. As used herein, a mobile device can include devices that are (or can be) carried and/or worn by the user. Mobile device 102 can be a phone (e.g., a smart phone), a tablet, a personal digital assistant (PDA), smart glasses, and/or a wrist-worn device (e.g., a smart watch), among other types of mobile devices.

The mobile device 102 can be connected to the gateway device 114 via the network 112. For example, the network 112 can provide for a network relationship between the mobile device 102 and the gateway device 114/control panel 116. Such a network relationship can be a wired or wireless network connection. Examples of such a network relationship can include a local area network (LAN), wide area network (WAN), personal area network (PAN), a distributed computing environment (e.g., a cloud computing environment), storage area network (SAN), Metropolitan area network (MAN), a cellular communications network, Long Term Evolution (LTE), visible light communication (VLC), Bluetooth, Worldwide Interoperability for Microwave Access (WiMAX), Near Field Communication (NFC), infrared (IR) communication, Public Switched Telephone Network (PSTN), radio waves, and/or the Internet, among other types of network relationships.

As described above, in some instances the mobile device 102 may not be in communication with the control panel 116. For instance, a facility may not have a network relationship available such that the mobile device 102 is unable to be in communication with the network 112 (e.g., as illustrated by the dashed line in FIG. 1). For example, a Wi-Fi connection via the network 112 may not be available for the mobile device 102 (e.g., as a result of renovation, new construction, etc.) As another example, the mobile device 102 may be located in an area of the facility having event devices 106 but may not have LTE connectivity available via the network 112 in such an area. Accordingly, the mobile device 102 can be in communication with the event devices 106 without being in communication with the network 112, as is further described herein, or through multiple networks.

The mobile device 102 can receive an inventory of the group 104 of event devices 106 from the gateway device 114. For example, prior to losing communication with the network 112, the mobile device 102 can receive, via the network 112, an inventory of the group 104 of event devices 106. The inventory can include an amount of event devices for a facility, for a space in the facility, etc. For example, the inventory received by the mobile device 102 can include the event devices 106-1, 106-2, 106-3 included in the group 104 of event devices.

When an inventory of the group 104 of event devices 106 is transmitted to the mobile device 102, the gateway device 114 can further transmit an enable signal to the group 104 of event devices 106. For example, the enable signal can be transmitted from the gateway device 114 to the control panel 116 and from the control panel 116 to each of the event devices 106. Such an enable signal can cause each event device 106-1, 106-2, 106-3 of the group 104 to enable their beacons 108-1, 108-2, 108-3, respectively. Such beacons 108 can be utilized to communicate with the mobile device 102 when the mobile device 102 is within range of the beacons 108, as is further described herein.

A user, such as a technician, engineer, etc., may carry mobile device 102 into different areas of the facility. For example, the user may carry the mobile device 102 into an area of the facility having the group 104 of event devices 106 in order to perform various actions that can include maintenance, commissioning, inspection, and/or other actions related to the event devices 106. The user can utilize the mobile device 102 to perform such actions, even when a network relationship between the mobile device 102 and the network 112 is unavailable, as is further described herein.

The mobile device 102 can generate, using the inventory, a device identification analysis for the group 104 of event devices 106. The device identification analysis for the group 104 of event devices 106 can include a list of event devices 106 included in the inventory, as is further described herein.

Such a list of event devices 106 included in the inventory can be based, for example, on the distance of the mobile device 102 to each event device 106 included in the group 104. The list based on the distance can be sorted such that the event devices 106 can be included in the list from highest signal strength to lowest signal strength. For instance, the list of event devices 106 can include the event device 106-1 listed first having the beacon 108-1 having the highest signal strength with the mobile device 102, the event device 106-2 can be listed second having the beacon 108-2 having the next highest signal strength with the mobile device 102, and the event device 106-3 can be listed third as having the beacon 108-3 having the lowest signal strength with the mobile device 102.

The user of the mobile device 102 can utilize the mobile device 102 to interact with event devices 106 of the group 104 that have communication capabilities. For example, the user of the mobile device 102 may utilize the mobile device 102 to interact with the event device 106-1 that is closest to the mobile device 102 and has hardware for transmission and/or reception of communication with the mobile device. The user can input information to the mobile device 102 to cause an event device 106 to take a service action, as is further described herein.

For example, the mobile device 102 can receive an input for the event device 106 of the group 104 that is closest to the mobile device 102 to take a maintenance action. As used herein, the term "service or maintenance action" refers to an act taken to ensure a device is kept in a specified condition, operation, or state or represents the commissioning of an event device. For example, the mobile device 102 can receive an input (e.g., a user input) for event device 106-1 (e.g., that is closest to the mobile device 102) to take a maintenance action.

The service action can include, for instance, modifying an address and/or a label of the event device 106 that is closest to the mobile device 102, recording inspection data about the event device that is closest to the mobile device 102, causing the event device 106 that is closest to the mobile device 102 to perform a maintenance self-test, generating a report, among other types of maintenance actions. The mobile device 102 can cause the maintenance action to be taken by the event device 106 of the group 104 that is closest to the mobile device 102 in response to the input.

Once the maintenance action is taken by the event device 106, the mobile device 102 can upload the maintenance action to a remote computing device 118. For example, upon completion of the maintenance action by event device 106-1, and upon the mobile device 102 establishing/re-establishing a network relationship via the network 112, the mobile device 102 can upload the maintenance action taken by the event device 106-1 to the remote computing device 118. For instance, the mobile device 102 may interact with the event device 106-1 to record inspection data about the event device 106-1 (e.g., event device 106-1 passed a visual inspection by a user of the mobile device 102), and such information can be transmitted to the remote computing device 118 via the network 112 when such a network relationship is active between the mobile device 102 and the network 112. Such uploading to the remote computing device 118 can ensure that maintenance actions taken by the event devices 106 via the mobile device 102 are properly synced in a cloud-computing environment (e.g., via remote computing device 118), especially when the mobile device 102 does not have an established network relationship via the network 112.

As described above, a user of the mobile device 102 can carry the mobile device 102 into different areas of a facility to perform various actions that can include auditing, maintenance, inspection, commissioning of new event devices, and/or other actions related to the event devices 106. In some instances, a user may not be able to distinguish between two closely located event devices 106 (e.g., event device 106-1 and event device 106-2). In such an instance, and when a network relationship between the mobile device 102 and the network 112 is established, the mobile device 102 can transmit an indicator signal to the gateway device 114 for the event device 106 of the group 104 that is closest to the mobile device 102.

For example, a user may have located event devices 106-1 and 106-2 in an area of the facility utilizing the mobile device 102. In response to an input, the mobile device 102 may transmit an indicator signal via the network 112 to the gateway device 114. The gateway device 114 can transmit the indicator signal to the event device 106-1 via the control panel 116.

The event device 106-1 can receive the indicator signal and emit an indicator in response to receiving the indicator signal. The user can then identify which device is device 106-1 and can provide a description via the user interface that can be stored in memory that describes, for example, where in the room or where, with respect to 106-2 or another device, device 106-1 is located. As described above, the indicator can be, for example, a visual indicator, an audible indicator, and/or a combination thereof. For instance, the event device 106-1 can activate an LED to emit a visible light (e.g., a strobe, continuous light, etc.) and/or activate an audio output device (e.g., a speaker, buzzer, etc.) to emit an audible sound. Such indicators can ensure a user of the mobile device 102 is interacting with the correct event device 106.

Figure 2:
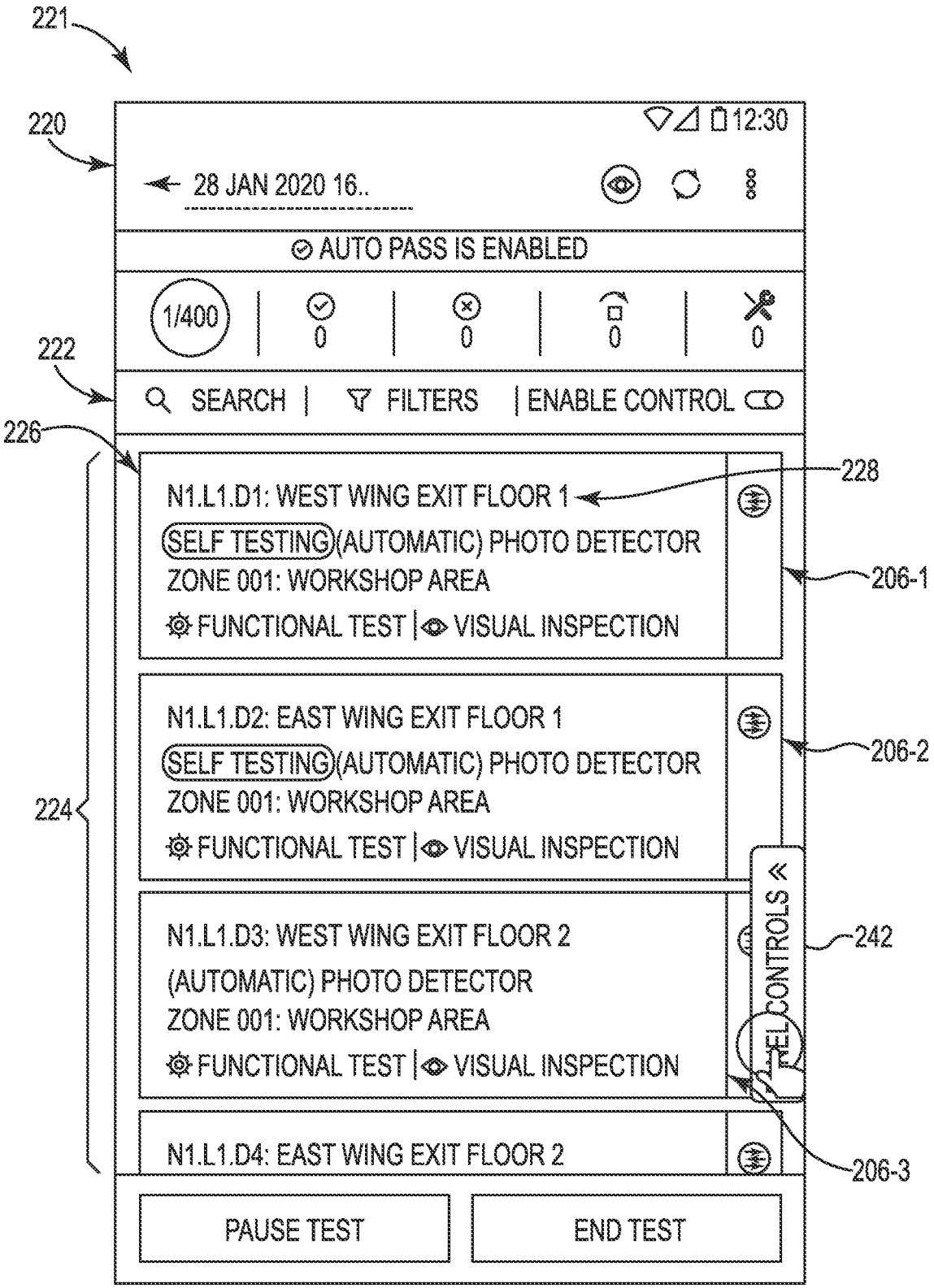
FIG. 2 is an illustration of a display provided on a user interface showing a device identification and self-test capabilities including a list of self-test and non-self-test devices, generated in accordance with one or more embodiments of the present disclosure.

FIG. 2 is an illustration of a display 221 provided on a user interface 220 showing device identification and self-test capabilities 222 including a list of self-test and non-self-test devices 224, generated in accordance with one or more embodiments of the present disclosure. The list 224 can include, for instance, information about event devices 206-1, 206-2, 206-3.

As illustrated in FIG. 2, the user interface 220 can be displayed on a mobile device. For example, the mobile device can generate a device identification analysis 222 which can be displayed via the user interface 220. The device identification analysis 222 can include a list 224.

As illustrated in FIG. 2, the list 224 can include event devices 206-1, 206-2, 206-3 (e.g., event devices 106-1, 106-2, 106-3, previously described in connection with FIG. 1). As previously described in connection with FIG. 1, such event devices 206 can each include a beacon.

Also as previously described in connection with FIG. 1, there may be additional event devices in the facility, but they may not include a beacon. In such an instance, those event devices can be included on the list 224, but may not be able to be automatically tested, rather, a visual test may be performed by the user while moving through the building with the mobile device. This could not previously have been accomplished as a technician would have had to have been at the control panel and another technician would have had to have been at the location of the event device.

Each device listing 206 can include a device identifier, such as a specific device address 226 and/or a location description 228. This can be helpful in determining which device is being tested and the location of devices need maintenance after testing has been completed, among other benefits. If a device identifier is used, it can, in some implementations, be physically matched with the identifier information provided on the device, for instance on a device that does not have an indicator.

In some examples, the mobile device can cause a maintenance action to be taken for the event device 206-1 by modifying an address 226 of the event device 206. For example, the address 226 for the event device 206-1 may be indicated on the user interface 220 as "N1.L1.D1", and the user may notice that address 226 is incorrect. The user may modify the address 226 by entering an input to the mobile device at the device identification analysis 222.

In addition or alternatively to modifying the address 226 of the event device 206, the mobile device can cause a maintenance action to be taken for the event device 206-1 by modifying a label 228 of the event device. For example, the label 228 for the event device 206-1 may be indicated on the user interface 220 as a location such as "West Wing Exit Floor 1", and the user may notice that label 228 is incorrect. The user may modify the label 228 by selecting a change label input 230 via the user interface 220 and can modify the label 228 accordingly.

Figure 4:
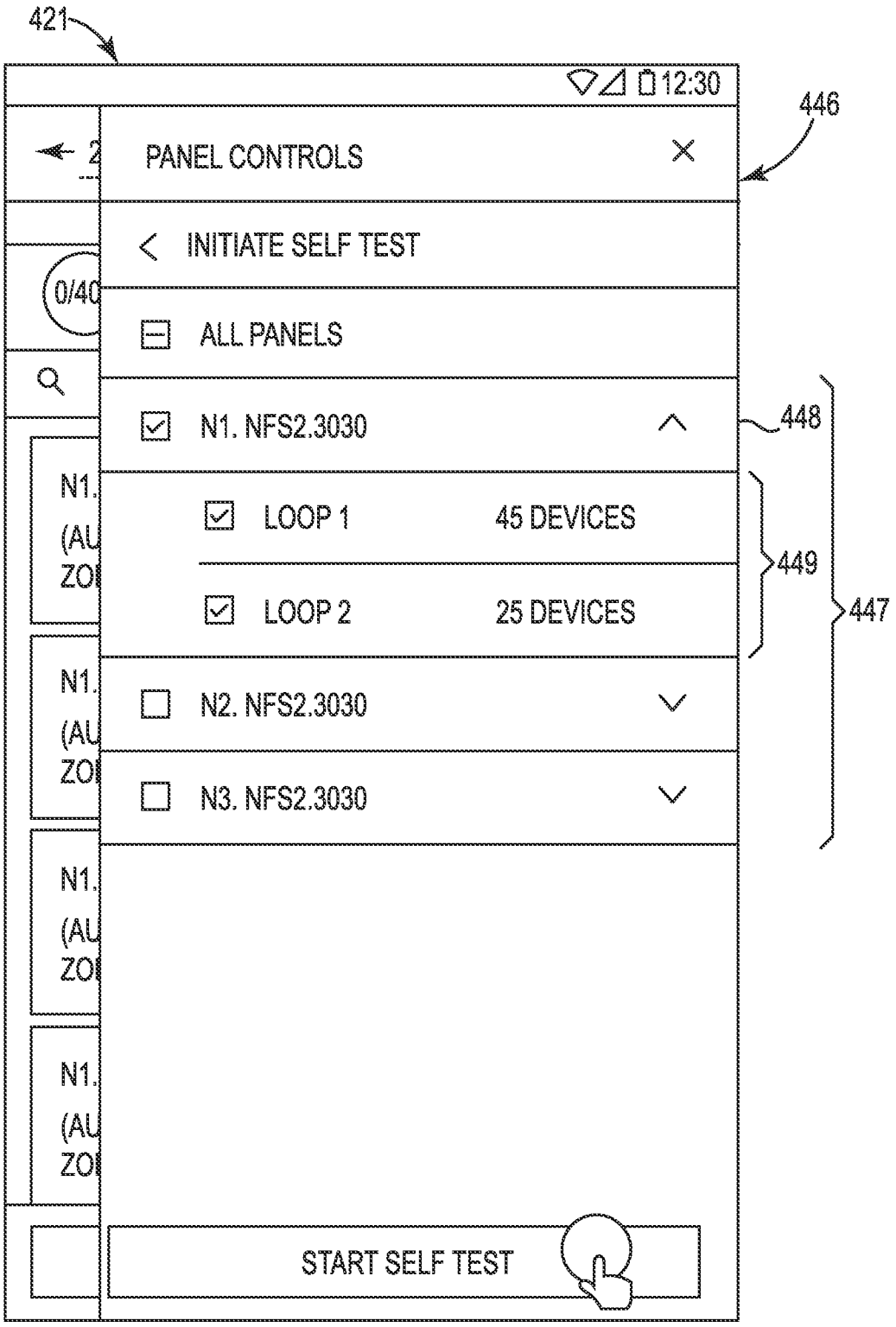
FIG. 4 is an illustration of a display provided on a user interface showing self-test selection parameters, generated in accordance with one or more embodiments of the present disclosure.
Figure 6:
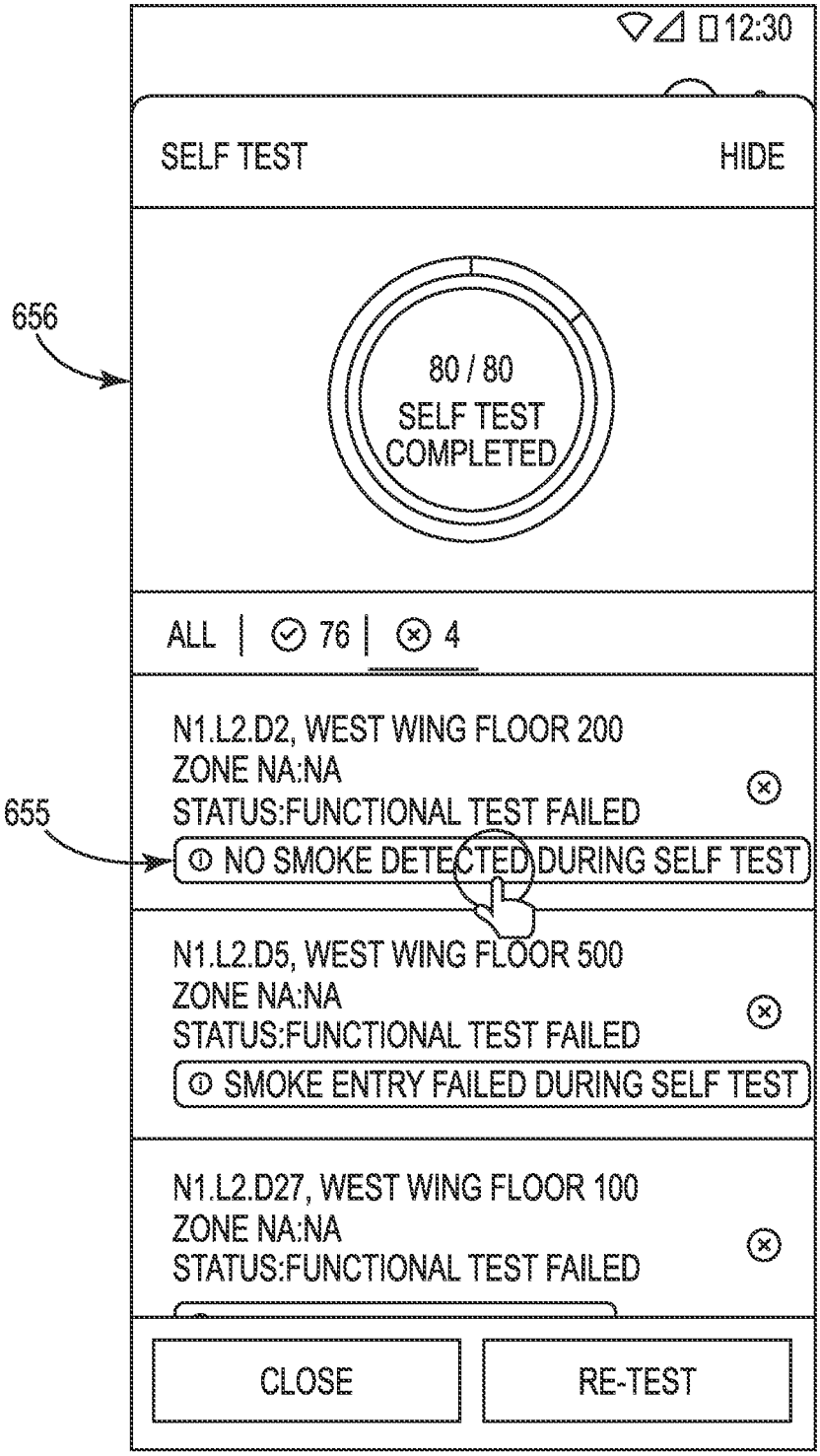
FIG. 6 is an illustration of a display provided on a user interface showing self-test completion information related to failed test results, generated in accordance with one or more embodiments of the present disclosure.

Additional maintenance actions can include a maintenance self-test. Such a test can occur during routine maintenance or during commissioning of one or more event devices. The mobile device can cause a maintenance action to be taken by causing the event device 206 to perform a maintenance self-test. For example, as previously described in connection with FIG. 1, the event devices 206 can be automatic, self-test devices on which a self-test can be performed in order to test the event device's specific sensing capabilities (e.g., smoke, CO, heat, etc.). The mobile device can cause the event device 206-1 to perform a maintenance self-test by selecting a maintenance self-test input 232 (e.g., "Start Self-Test") as illustrated in FIG. 4. Further, in the event the event device 206-1 fails the maintenance self-test, the mobile device can cause the event device 206-1 to take other actions (e.g., take corrective measures, re-running the maintenance self-test, as indicated in FIG. 6, etc.).

The mobile device can cause a maintenance action to occur by recording, for an inspection, inspection data about a specific event device 206. For example, the user of the mobile device may perform a visual inspection of the event device 206-1 and can record audible notes about the event device 206-1 via an audio input device of the mobile device (e.g., a microphone), can record textual inputs about the event device 206-1 to the mobile device via the user interface 220, can record photos and/or video of the event device 206-1 via an image capture device (e.g., a camera) of the mobile device, etc.

The mobile device can generate a report about the maintenance action. For example, the mobile device can generate a report for the event device 206-1 detailing results of any maintenance self-tests executed, detailing inspection data, any address 226 or label 228 modifications, among other information. Further, the mobile device can add a signature to such a report, where the signature which may be used, for example, for audit purposes to determine whether service was completed and/or who did the service.

Lastly, the mobile device can upload the maintenance action to a remote computing device. For example, as previously described in connection with FIG. 1, the mobile device can upload the maintenance action including any generated reports to a remote computing device upon establishing/re-establishing a network relationship via a network to ensure that any maintenance actions taken by the event devices 206 via the mobile device are properly synced.

In some instances, an event device may detect an actual hazard event occurring in the facility. In such an instance, the mobile device may terminate the maintenance action in response to the hazard event being detected by the event device 206. For example, while the user is recording inspection data for the event device 206-1, the event device 206-1 may detect levels of CO in the building space that exceed a threshold amount and as a result determine a hazard event is occurring. The mobile device can, in response, terminate the recording of inspection data to allow the event device 206-1 to transmit information regarding the CO levels in the building space to a control panel.

Also illustrated in FIG. 2, the user interface 220 includes a panel controls tab 242 that allows a user to initiate certain functions of the maintenance system and change maintenance system data.

Figure 3:
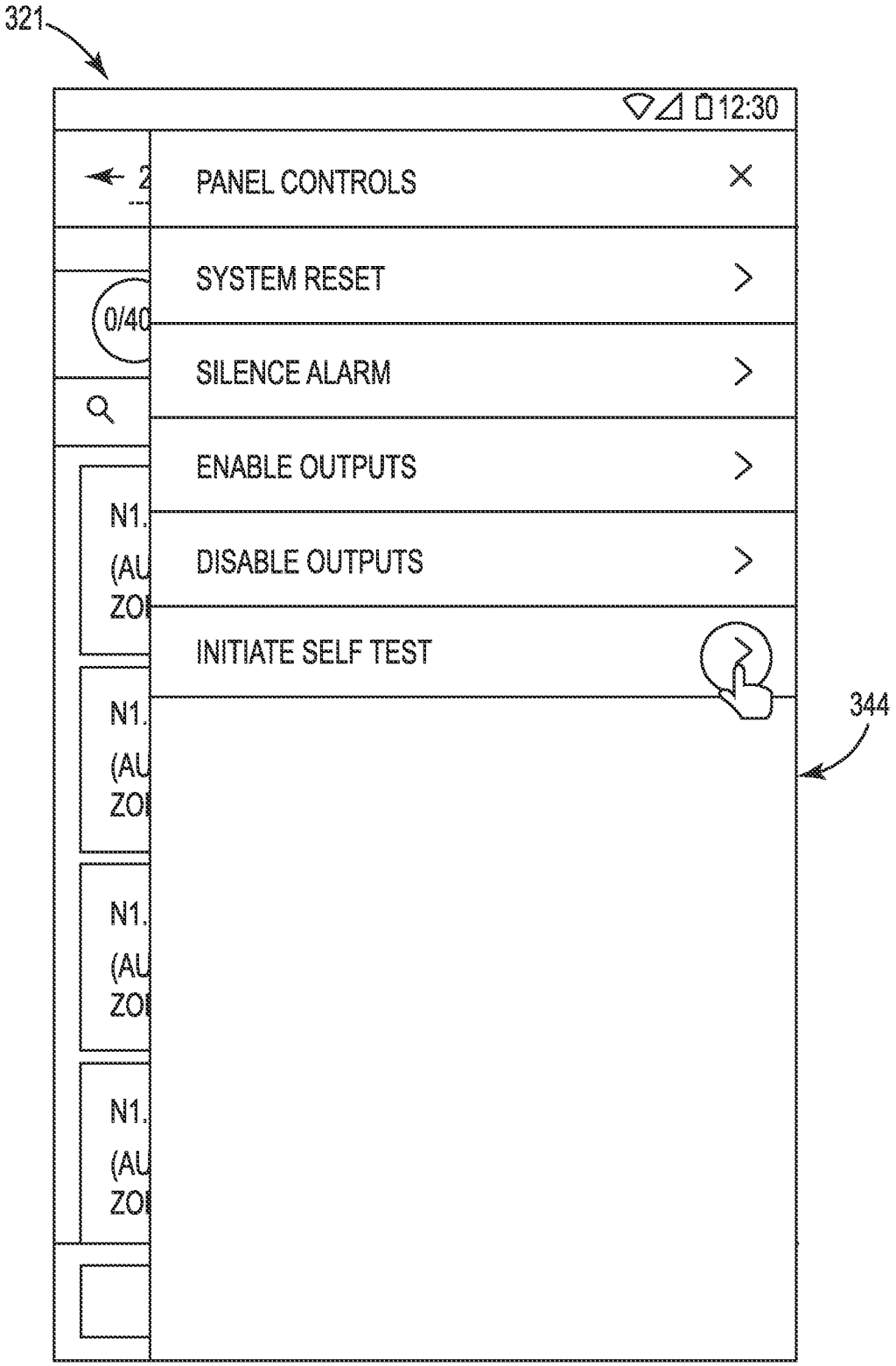
FIG. 3 is an illustration of a display provided on a user interface showing different application capabilities for selection by a user, generated in accordance with one or more embodiments of the present disclosure.

FIG. 3 is an illustration of a display 321 provided on a user interface showing different application capabilities 322 for selection by a user, generated in accordance with one or more embodiments of the present disclosure. The display can include a list 344 that can include, for instance, functions that can be accomplished via the user interface. For example, as illustrated, the list can include: system reset, silence alarm, enable outputs, disable outputs, and initiate self-test.

Clicking, by the user, on the system reset allows the user to be away from the control panel but still be able to reset the system if, for example, an event device is not responding or if they see a condition with several event devices that would be resolved by a system reset. This could be accomplished, for example, by the user initiating the system reset by selecting the system reset from the list 344, in response to the selection, the mobile device application sending a system reset initiation message to the control panel (e.g., via the network 112, through the gateway 114), whereby the control panel software application interprets the initiation message and begins the system reset process (e.g., a process stored in memory as computing device executable instructions stored in memory in the control panel and executable by a processor therein).

By the user selecting silence alarm, the user can be away from the control panel but still be able to silence an alarm actuated by the control panel if, for example, an alarm is actuated during a test of an event device. Similarly to the system reset, this could be accomplished, for example, by the user initiating the system reset by selecting silence alarm from the list 344, in response to the selection, the mobile device application sending a silence alarm message to the control panel (e.g., via the network 112, through the gateway 114), whereby the control panel software application interprets the silence alarm message, and silences the alarm (e.g., a process stored in memory as computing device executable instructions stored in memory in the control panel and executable by a processor therein).

By the user selecting enable or disable outputs, the user can be away from the control panel but still be able to enable or disable outputs via the control panel if, for example, a technician is going to do something that may initiate an output during a test of an event device or after such a process is accomplished and the system must be returned to an enabled output mode for normal operation.

This is beneficial as in prior systems, their typically required two technicians (one at the event device being worked on and one at the control panel). Otherwise, the single technician would need to observe the event device to be worked on, travel to the control panel, disable the outputs, travel back to the event device, perform the work, travel back to the control panel, and enable the outputs. This resulted in extra technicians and/or more technician time spent and more time that the system was disabled.

Similarly to the system reset, the enabling and disabling of the outputs could be accomplished, for example, by the user initiating the enabling or disabling of the outputs by selecting the appropriate tab from the list 344, in response to the selection, the mobile device application sending an enable or disable message to the control panel (e.g., via the network 112, through the gateway 114), whereby the control panel software application interprets the enable or disable message, and enables or disables the outputs (e.g., a process stored in memory as computing device executable instructions stored in memory in the control panel and executable by a processor therein).

If the user selects initiate self-test, the user can initiate a self-test of a number of event devices from the mobile device via the mobile application. This is beneficial as in prior systems, the testing had to be accomplished by a technician being physically present at each event device a performing the test procedure. This would involve, traveling to the control panel, disabling the outputs, traveling to each event device, performing the testing, traveling back to the control panel, and enabling the outputs.

In such processes, the system was put into standby mode, where the outputs are disabled for the entire time the testing of all event devices were being test. This resulted in extra technicians and/or more technician time spent and more time that the system was disabled. The initiation of a self-test could be accomplished, for example, as detailed below in addition to other functions described therein.

FIG. 4 is an illustration of a display 421 provided on a user interface showing self-test selection parameters 446, generated in accordance with one or more embodiments of the present disclosure. These self-test selection parameters are displayed on the display when the user selects initiate self-test from the list 344 of FIG. 3.

As illustrated in FIG. 4, the device selection tool that provides the illustrated functionality in FIG. 4 can allow a user to select all devices in the system (described as all panels, of an alarm system having multiple control panels 447, in FIG. 4) connected to the alarm system or select one or more groups 448 and/or 449 of event devices (e.g., devices of panel N1.NFS2.3030 from loop 1, containing 45 devices, and loop 2, containing 25 devices, but no devices from N2.NFS2.3030 or N3.NFS2.3030). In such an embodiment, the user can initiate the testing on certain event devices while other parts of the alarm system are still in normal operation. This is beneficial because it reduces the risk that a hazard event will occur that will not be detected by an event device during the testing period.

Additionally, once the devices to be tested are selected, the self-testing of those devices can be initiated by a self-test initiation tool wherein the user can select start self-test on the user interface screen 446. The initiation of the self-test process sends an initiation message from the mobile application on the mobile device to each event device to be tested (selected devices 449 in FIG. 4). Based on receipt of the initiation message, the event device initiates computing device executable instructions that are stored in memory on the event device and executable on a processor thereon. This allows the user to test many devices in a batch from the mobile device application rather than one at a time physically.

Figure 5:
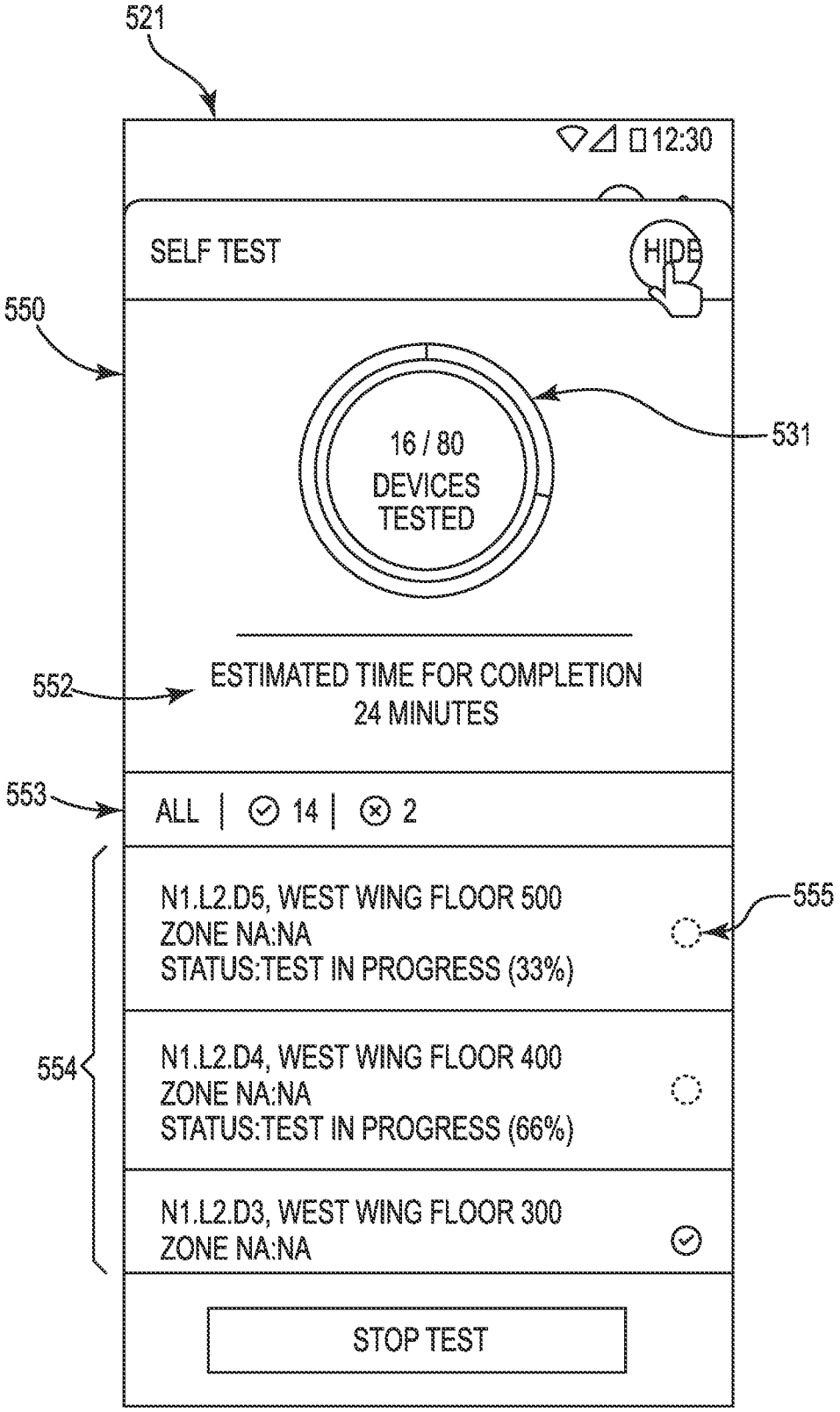
FIG. 5 is an illustration of a display provided on a user interface showing self-test status screen, generated in accordance with one or more embodiments of the present disclosure.

FIG. 5 is an illustration of a display 521 provided on a user interface showing self-test status screen 550, generated in accordance with one or more embodiments of the present disclosure. In various embodiments the display 521 will provide status information on the status screen 550. For example, as devices have run their self-test process the display can provide the number of devices that have completed their self-test (e.g., number completed versus total number selected to be tested) at 531, an estimate of the time for completion of the self-tests for the devices selected to be tested 552, the number of devices passing their tests and the number that failed their tests 553, list of devices being tested 554, and status information 555 (e.g., visual status indicator and/or text).

Some types of overall testing status indicators are shown in FIG. 5. For example, there is a circular indicator that can be color coded to indicate the amount of testing completed and/or left to complete (e.g., a portion having a first color representing the percentage of devices completed, a portion having a second color representing the percentage of devices left to complete, and/or a portion having a third color representing devices currently under self-testing). FIG. 5 also illustrates that text can be used to provide overall status. For example, the overall status can be provided as a comparison of the number of tests completed versus the total number of tests. In some embodiments, the number of tests remaining can be provided.

Overall status is also provided as an estimated time for completion of the overall testing process. The estimate can be accomplished by any suitable technique. For example, the mobile application can have data stored in memory providing an estimate of one or more tests, can calculate an estimate based in the time it has taken to complete past system tests administered on the present system or by the mobile application, or calculate the estimate based on completion timing data from completed tests of the present testing process, among other methods.

In FIG. 5, at 553, the display provides an indicator of the number of devices that have passed and failed their self-tests. In some embodiments, these can be selectable links that a user can select to limit the display of the device information in area 554 below. This can be beneficial to assist the user in identifying which devices failed, among other benefits.

The area 554 is a list of devices that have completed their self-test, are currently performing their testing, or have yet to begin their test. In the illustration of FIG. 5, two devices are presently in the testing process (33% and 66% complete and indicated by the dash circle) and one device has completed and passed its self-test (as indicated by the circle with the check mark).

FIG. 5 also includes an interruption tool to stop the testing. As shown, a button is provided on the display that allows the user to pause or stop self-testing of one or more of the selected event devices. This can be beneficial, for example, where an alarm is set off on a normally operating event device and it is desirable to have the entire system or parts thereof revert to normal operating mode in case an area under test or scheduled to test could be subject to a hazard event.

FIG. 6 is an illustration of a display provided on a user interface 656 showing self-test completion information related to failed test results, generated in accordance with one or more embodiments of the present disclosure. Once all selected event devices have completed their self-testing, the status can be displayed (e.g., with a completed circle and/or showing different colors representing devices that passed versus failed and/or text such as an indication that the self-test process is completed). The display can also list the problems in the failed self-tests that warranted the failure of the test. For example, at 655 no smoke was detected during self-test. This can aid the technician in diagnosing whether the event device should be fixed or replaced or whether something else needs to be done to the system to remedy the issue identified.

Also illustrated is a re-test button. The user can select this button to initiate a re-test of one or more of the event devices that failed the self-test. This can be beneficial as the technician can initiate this via the mobile device and can do so for a select few devices rather than testing all of the selected devices (as selected in FIG. 4) or all system devices again. The process for initiating a re-test is substantially the same as initiating the self-test on the originally selected devices in FIG. 4, except that for the re-test there are less selected devices as the devices to be re-tested are only those that failed a previous test. Such functionality can save substantial technician time and system downtime, among other benefits.

Figure 7:
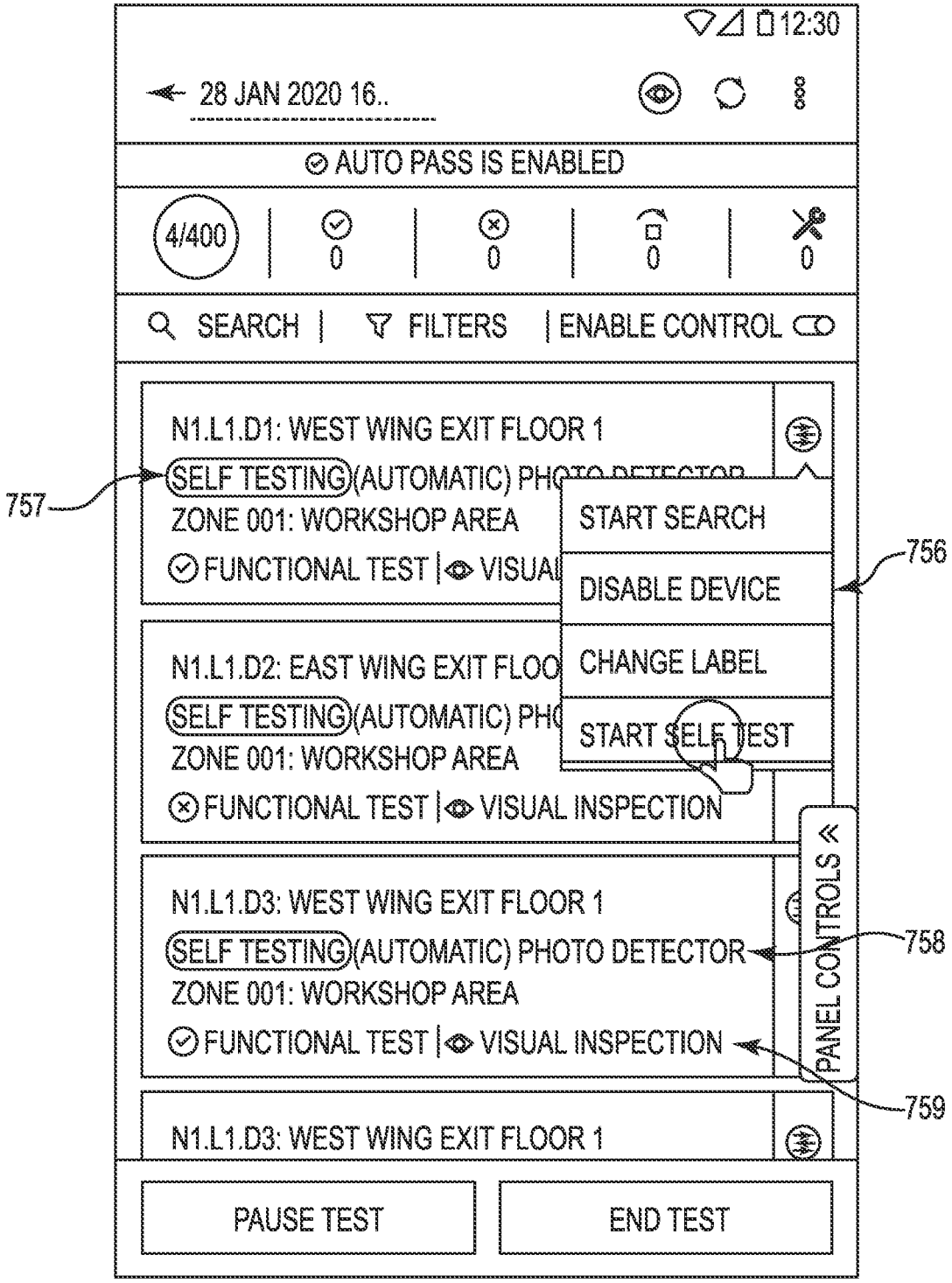
FIG. 7 is an illustration of a display provided on a user interface showing application capabilities, generated in accordance with one or more embodiments of the present disclosure.

FIG. 7 is an illustration of a display provided on a user interface showing application capabilities, generated in accordance with one or more embodiments of the present disclosure. In some embodiments, as shown in FIG. 7, the user interface can include a number of other functionalities that can be used with individually selected event devices.

For example, the user interface can include the capability to search for a specific event device. For instance, in FIG. 7, at 756, the list includes a user selectable tab that can allow a user to start searching for a specific device. The search criteria can be a suitable search type. Examples of suitable searching criteria can include: device identifier, device address, device location, keyword, type of testing, and/or whether device has self-test capability, among other suitable criteria.

The mobile application shown in FIG. 7 also includes the capability to disable individual devices. This can be beneficial as this can keep the rest of the alarm system operating normally while an issue with a specific device is addressed.

This can also be done on the mobile device which could be at the location of the specific event device. This is beneficial as heretofore the technician would have to take all system devices offline from the control panel meaning the entire system would be offline while the technician traveled from the control panel to the specific event device and back again.

In some instances, the label associated with a particular event device may need to be added to the alarm system or may need to be updated. As illustrated at 756 of FIG. 7, an implementation can have a change label tab that allows a user to change the label stored in memory. Since this functionality is on the mobile application, this information can be added/changed while the user is near the particular event device needing that information added/changed.

Additionally, some embodiments include non-self-test devices on their list of devices displayed on the mobile device. Accordingly, in some embodiments, the display can include, for example, a symbol or text indicator 757 that a device has a self-test capability. Embodiments can also include the types of testing that should be performed (e.g., functional test, whether that test can be performed by self-testing, and/or visual inspection).

Figure 8:
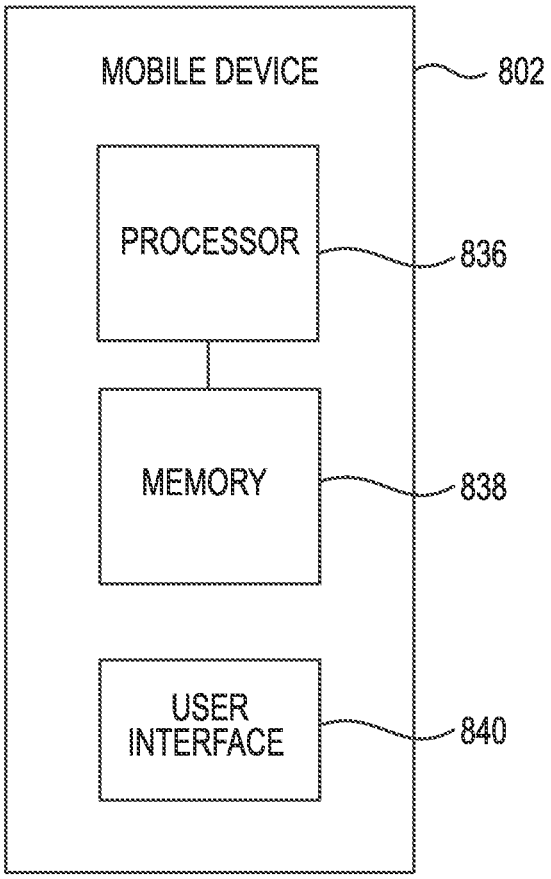
FIG. 8 is an example of a mobile device for event device service, in accordance with one or more embodiments of the present disclosure.

FIG. 8 is an example of a mobile device 802 for event device maintenance, in accordance with one or more embodiments of the present disclosure. As illustrated in FIG. 8, the mobile device 802 can include a memory 838 and a processor 836 for event device maintenance in accordance with the present disclosure.

The memory 838 can be any type of storage medium that can be accessed by the processor 836 to perform various examples of the present disclosure. For example, the memory 838 can be a non-transitory computer readable medium having computer readable instructions (e.g., executable instructions/computer program instructions) stored thereon that are executable by the processor 836 for event device maintenance in accordance with the present disclosure. The computer readable instructions can be executable by the processor 836 to redundantly generate an automated test analysis for event device testing.

The memory 838 can be volatile or nonvolatile memory. The memory 838 can also be removable (e.g., portable) memory, or non-removable (e.g., internal) memory. For example, the memory 838 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 838 is illustrated as being located within mobile device 802, embodiments of the present disclosure are not so limited. For example, memory 838 can also be located internal to another computing resource (e.g., enabling computer readable instructions to be downloaded over the Internet or another wired or wireless connection).

As illustrated in FIG. 8, mobile device 802 includes a user interface 840. For example, the user interface 840 can display a device identification analysis (e.g., as previously described in connection with FIGS. 1-7) in a single integrated display.

A user (e.g., operator) of mobile device 802 can interact with mobile device 802 via user interface 840. For example, user interface 840 can provide (e.g., display and/or present) information to the user of mobile device 802, and/or receive information from (e.g., input by) the user of mobile device 802. For instance, in some embodiments, user interface 840 can be a graphical user interface (GUI) that can provide and/or receive information to and/or from the user of mobile device 802. The display can be, for instance, a touch-screen (e.g., the GUI can include touch-screen capabilities). Alternatively, a display can include a television, computer monitor, mobile device screen, other type of display device, or any combination thereof, connected to mobile device 802 and configured to receive a video signal output from the mobile device 802.

As an additional example, user interface 840 can include a keyboard and/or mouse the user can use to input information into mobile device 802. Embodiments of the present disclosure, however, are not limited to a particular type(s) of user interface.

User interface 840 can be localized to any language. For example, user interface 840 can utilize in any language, such as English, Spanish, German, French, Mandarin, Arabic, Japanese, Hindi, etc.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A mobile device for self-testing event devices of a building alarm system, comprising:

a user interface;

a memory; and a processor configured to execute executable instructions stored in the memory to:

generate, a list of self-test event devices of an alarm system that are available for self-testing wherein the list of event devices available for self-testing is generated based on an inventory of a group of self-test event devices, the inventory received from a gateway device and created by a control panel of the building alarm system;

provide a device selection tool that allows a user to select a number of self-test event devices from the list of event devices; and provide a self-test initiation tool that generates an initiation message that is to be sent to the selected number of event devices that initiates a self-test on each selected self-test event device, wherein the self-test produces a material to test the sensing for at least one of temperature, chemical presence, or aerosol presence, wherein the mobile device includes a display and wherein the processor is configured to execute the instructions to display a status of a self-test process while the self-test process is being executed.

2. The mobile device of claim 1, wherein the processor is configured to execute the instructions to disable outputs of the selected number of self-test event devices.

3. The mobile device of claim 1, wherein the processor is configured to execute the instructions to enable outputs of the selected number of self-test event devices.

4. The mobile device of claim 1, wherein the processor is configured to execute the instructions to:

provide a self-test interruption tool that generates an interruption message that is to be sent to at least one of the selected number of self-test event devices to pause or cancel a self-test initiated by the initiation message.

5. The mobile device of claim 1, wherein the list of self-test event devices includes self-test event devices controlled by the alarm control panel and wherein the device selection tool allows the user to select all of the number of self-test event devices of the alarm control panel with a single selection from the list of self-test event devices.

6. The mobile device of claim 1, wherein the list of self-test event devices includes self-test event devices controlled by multiple alarm control panels and wherein the device selection tool allows the user to select all of the number of self-test event devices of one of the multiple alarm control panels with a single selection from the list of self-test event devices.

7. The mobile device of claim 1, wherein the processor is configured to execute instructions to display a status of a self-test process of each of multiple devices performing a self-test concurrently while the self-test process is being executed on at least one of the multiple devices.

8. The mobile device of claim 1, wherein the status of the self-test process is presented by at least one of: a text indicator or a graphic indicator.

9. A system for self-testing event devices of a building alarm system, comprising:

a number of event devices;

a control panel to control the operation of the number of event devices; and mobile device for self-testing event devices of an alarm system, comprising:

a user interface;

a memory; and a processor configured to execute executable instructions stored in the memory to:

generate, a list of self-test event devices of an alarm system that are available for self-testing wherein the list of self-test event devices available for self-testing is generated based on an inventory of a group of event devices, the inventory received from a gateway device and created by the control panel of the building alarm system;

providing a device selection tool that allows a user to select a number of self-test event devices from the list of self-test event devices;

providing a self-test initiation tool that generates an initiation message that is to be sent to the selected number of self-test event devices that initiates a self-test on each selected self-test event device, wherein the self-test produces a material to test the sensing for at least one of temperature, chemical presence, or aerosol presence; and wherein the mobile device includes a display and wherein the processor is configured to execute the instructions to display a status of a self-test process while the self-test process is being executed.

10. The system of claim 9, wherein the status of the self-test process is presented by a comparison of a number of self-tests completed and a number of total self-tests to be completed.

11. The system of claim 9, wherein the status of the self-test process is presented by an estimated time for completion.

12. The system of claim 9, wherein the status of the self-test process is presented by a number of passed tests and a number of failed tests.

13. The system of claim 9, wherein the processor is configured to execute executable instructions stored in the memory to allow the user to select a type of self-test event device displayed in the mobile device.

14. The system of claim 13, wherein the user selects at least one type of the group of types including: all self-test event devices of the alarm system, devices that have passed a self-test, devices that have failed a self-test, and devices that are currently in a self-test condition.

15. A computer implemented method for performing event device self-testing, comprising:

generating, via a mobile computing device having a processor and memory, a list of self-test event devices of an alarm system that are available for testing wherein the list of self-test event devices available for testing is generated based on an inventory of a group of event devices, the inventory received from a gateway device and created by a control panel of the building alarm system;

providing a device selection tool that allows a user to select a number of self-test event devices from the list of event devices;

providing a self-test initiation tool that generates an initiation message that is to be sent to the selected number of self-test event devices that initiates a self-test on each selected self-test event device, wherein the self-test produces a material to test the sensing for at least one of temperature, chemical presence, or aerosol presence; and displaying a status of a self-test process on a display of the mobile computing device while the self-test process is being executed.

16. The method of claim 15, wherein the self-test event devices are included in the list from highest signal strength to lowest signal strength.

17. The method of claim 15, wherein a status of self-tests is displayed on a display of the mobile device and wherein the status is color coded based on a status of each self-test.

18. The method of claim 17, wherein the past, failed, and in process test results are presented on the display by different colors.

19. The method of claim 15, wherein the method includes generating, via the mobile computing device, a list of self-test event devices that failed a self-test.

20. The method of claim 15, wherein the list of self-test event devices that failed a self-test includes a description of the reason for the failure of the self-test.

* * * * *